United States Patent [19]

Banner

[11] 4,010,822

[45] Mar. 8, 1977

[54] BUILDING EMERGENCY EXIT MEANS

[76] Inventor: Philip M. Banner, 28 Oxford Road, Massapequa, N.Y. 11758

[22] Filed: Feb. 20, 1974

[21] Appl. No.: 444,148

[52] U.S. Cl. ..... 182/18; 182/47; 182/48; 182/178; 52/79.2; 52/236.3; 52/79.8

[51] Int. Cl.[2] ..... A62B 1/20

[58] Field of Search ..... 182/18, 19, 48, 178, 182/47; 52/79, 236

[56] References Cited

UNITED STATES PATENTS

| | | | |
|---|---|---|---|
| 304,619 | 9/1884 | Cullen | 182/48 |
| 435,778 | 9/1890 | Stoddard | 182/48 |
| 2,823,424 | 2/1958 | Reinhold | 52/236 |
| 3,392,380 | 7/1968 | Fordyce | 182/18 |
| 3,750,366 | 8/1973 | Rich | 52/79 |

*Primary Examiner*—Reinaldo P. Machado

[57] ABSTRACT

A building Emergency Exit Means mounted to a wall of a building, a modular enclosure of interlocking design comprising one story units having a built-in emergency door, a ladder, a platform with a climb-through opening, an alarm system, lighting, ventilation and communications for all sizes of buildings.

11 Claims, 4 Drawing Figures

BUILDING EMERGENCY EXIT MEANS

Figure 1:
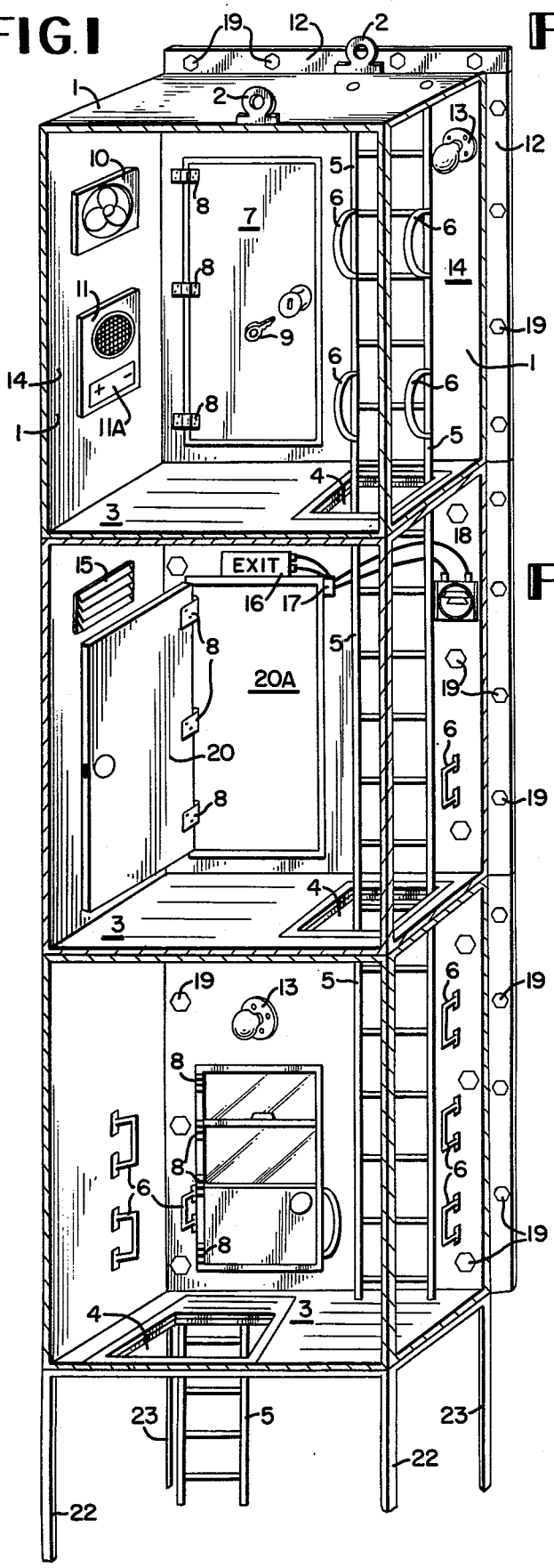

The present application is an improvement in building emergency exit development particularly as a complete enclosure containing all of the utilities necessary for a one story emergency exit, stackable to any desired height, on the wall of a building.

Modern hi-risers in the form of office buildings and tenements are presently built to accommodate air-conditioned temperature controlled offices and rooms that have non-opening type windows. The threat of smoke or fire is something everyone is concerned about, the air-conditioning ducts would circulate gasses and fumes in moments throughout an entire building, trapping all its occupants, having no means of escape. Toxic fumes from insulation on wiring, smoke from any rubbish or materials in a building each present the problem that requires some thought as to how people can escape from any floor in a building and ascend or descend to a safe area. The classic example occurred at the Patent Office in Arlington where while discussing my prior patent on a emergency fire escape device the examiners asked how anyone could get out of these building that have tempered glass windows and so few exits, and how to escape a smoke condition, it presents a problem in building design. Very often, smoke conditions can be much more dangerous than having an actual fire, the matter of safety is involved that this patent application, is concerned with.

The present application involves one story modular fire-proof units, made of fire-resistant materials and weatherproofed to resist enironmental hazards having permanent or flexible fire escapes, attached therein to the unit, which is actually an enclosure attached to a building. While the illustrated drawings show a four sided enclosure it does not preclude the use of a three sided enclosure to facilitate the desired safety. A four sided enclosure would include having an emergency door in the enclosure and the three sided enclosure would use a emergency door and opening in the building. In new buildings, the cutouts would be made to receive units with or without the doors, that have locking means for entry or exit, in an emergency situation. This would permit occupants to leave the area and descend to safety while it provides an absolutely safe entry for fire-fighters to have access to any floor of a building. Although not shown in the drawings, it would be desirable in some instances to develop these modular units with interlocking pipes that would supply extinguishing fluids for fire-fighting use, and the supply could be attachable from the lowest modular unit on the ground. The units illutrated do not show an exit door placed in the front or sides as may be desired for entry or exit on the lowest unit. However, should other units require doors for exit above the ground level such would easily be available, that in addition would provide the use of my fire escapes shown in U.S. Pat. No. 3,692,145 or the The Emergency Fire Exit Means shown in application Ser. No. 284,630, each providing a safe external means of exit. The present application illustrates a fixed position ladder having safety grip handles placed where needed and the design of the platform affords safety loads plus maneuverability space where people coming through the exit door or windows will not interfere with the people climbing down. It provides potential resting areas in cases of long descent and the symmetrical placement of the opening will afford efficient lowering of victims from any height to the ground floor. The design of these enclosures could be made to accommodate a second opening and additional openings with additional ladders to allow any number of people to use the device and escape to safety at one time. The width of the enclosure would vary in accordance with the requirement, the preferred use of a rectangular design would most likely protrude the least, a matter of choice. The platform would be designed for non-skid safety and the door would conform to fire door standards. The doors can be made to open only from the inside manually and by those with a key from the outside. However, an automatic locking means could work together with an existing alarm system wherein the setting off of an alarm would automatically open all doors, each provided with electrical locks to accomplish this. Another means of exit could include a pull ring such as used on present airplanes, that when pulled would set off the emergency alarm system which would also designate the area of trouble. The use of the present methods employing the necessity of breaking a transparent enclosure to get at the release handle would also do the job. After the occupants have opened the emergency exit door into the building emergency exit means they would use the provided communication phone to describe the problem of fire, smoke or victims that require emergency aid. Each of the enclosure modular units are provided with a ventilation system where required, the drawings show electrical and ordinary ventilation means. Being on the outside of a building it would limit the smoke automatically provided that that each exit door had automatic means of closing with an ordinary door check, returning to a closed not a locked position. If the smoke was coming into the enclosure from the outside, the vent could be closed from the inside on one side of the enclosure and opened manually on the other side permitting fumes and smoke to leave. The top modular unit placed on the highest story would have a ventilated cover allowing the rising heat and smoke to escape and furthermore can be provided with a large top ventilating fan having its own power source in case of failure and means at the bottom for adaptation of a secondary power source in case of failure. If a 12 Volt system were used it could then be operated by the alternator of a fire truck or car or separate generator if desired, having battery or AC supplied current. The ladders lock into the modules as illustrated on the drawings providing vertical rigidity for handling great loads. The communication system phone would also have a connection jack so that when the modules are placed together the proper connections have been made. This phone would have a station number on it and could be connected to the fire department or to any desired source. Means is shown in the modular wherein when the exit door or window is opened it will set-off an alarm that is battery operated as shown or can be connected to any source of power. The enclosure unit is shown having an emergency exit light and could have other lights as also shown. Several methods of attaching each module is shown in the accompanied drawings and it would be practical on big buildings to place these units side by side, locking them together and to the building into one integral unit. One of the plaforms is shown having the cutout placed under the exit which would change the order of descent for those who fear height, so that when they look down they will only see the floor below, it will have psychological effects. Also the placement of the cutout can be made so that it is neither under the exit or the ladder and placed inbetween. In providing the modular emergency exit means without a exit door, it would be locked on the building and the proper size cutout made into the building, having its own door and frame to meet fire-requirements, where available. The enclosure module can be raised into place by ordinary rigging methods using block and tackle or by a crane, when placed upon a building already built, locking each unit into each other and to the building. The units show lifting rings on top that can also be placed upon the sides if necessary, the points of lifting would be reinforced to carry the weight. The anchoring base can be made adjustable to set the proper height of the bottom unit which after being set would be reinforced permanently in that position. Units would be made from standard and special heights of buildings or provided with adapters, not shown in the drawings, for adaptation so that the modules will fit any building floor height required. Bolting the emergency exit enclosures on to buildings by bolts inside the enclosure or by bolting the exterior flange is a matter of choice and decor. These units can be made having air ducts to each floor separately or in any combination of floors and therefore keep the enclosure entirely free from fumes and smoke, powered by emergency supply means internally or externally. The bolted areas of the exterior would be covered by facia covers so that the modular exit enclosure would become a functional and good looking addition to modern buildings and further, can be provided of aluminum, stainless steel or fibreglass in any colors, or other materials as may be required for specific use as an emergency exit means. Such as in the case of emergency fire escape devices where there are no codes todate, it is anticipated that the presentation of these new modular exit units will also require new building and fire codes. The modular units can be made in more than one story as units.

Accordingly, it is a principal object of the invention to provide a new and improved Building Emergency Exit Means, for private homes, tenements, office buildings, hospitals and buildings of other use requiring a safety exit.

Another object of the invention is to provide new and improved emergency exit enclosures in single floor modular units having all the safety devices needed in an emergency situation.

Another object of the invention is to provide new and improved enclosures adaptable to buildings that have more than one module connected together serving more than one floor at a time, and having a ladder opening common to each enclosure vertically.

Another object of the invention is to provide an emergency exit enclosure means having its own source of ventilation internally and externally for disposing of fumes, smoke and fire hazards.

Another object of the invention is to provide new and improved enclosures having communications, alarm and lighted exit means all pre-wired and connected by attachment of the modular units.

Another object of the invention is to provide new and improved emergency exit enclosures means having a platform of non-skid materials and a opening in the platform to allow the passage of people between floors to escape a hazardous situation.

Another object of the invention is to provide new and improved emergency exit means that would permit more than one enclosure to be connected together horizontally providing more than one unit to be connected together sideways to provide any additional amount of fire escape passageways as may be required for populated buildings, in emergency.

Another object of the invention is to provide a modular ladder for interfloor use that is connected to each enclosure separately, having holding brackets and the ladder placed in a stand-off position safely away from the building or the enclosure wall allowing safe ascent or descent.

Another object of the invention is to provide exits in the form of doors or windows from a building into an enclosure that has locking means useful for entry or exits in emergency.

Another object of the invention is to provide interlocking modules of enclosures easily lifted on to the side of a building and locked into place by means of pre-disposed connecting parts and hardware and having lifting hooks means for rigging purposes.

Another object of the invention is to provide a symmetrical opening in each modular vertically so that said opening can be utilized for getting equipment up or down and said opening will also allow the lowering of injured persons from highly populated modern and older buildings.

Another object of the invention is to supply an enclosure with staggered opening so that persons using it at great heights will not fear climbing down or let fear bother them when they can not see the bottom, or cant fall too far.

Another object of the invention is to supply an enclosure having many necessary types of emergency equipment located in it for the treatment of injured persons, such equipment being placed in an emergency first aid closure attached to the wall.

These and other objects of the invention will be apparent from the following specifications and drawings, of which I seek letters patent on.

FIG. 1 is a perspective view of the upper part of an embodiment of the invention showing an exploded view of the enclosure without the front wall and side wall and further is a perspective view of the middle part of an embodiment of the invention showing vertical attachment of the enclosure to other module enclosures of this patent and is a perspective view of an embodiment of the invention showing the use of a window instead of a door and the opening in an offset position and further is the perspective view of the framework or legs of another modular enclosure, showing the continued vertical placement of the structure.

Figure 2:
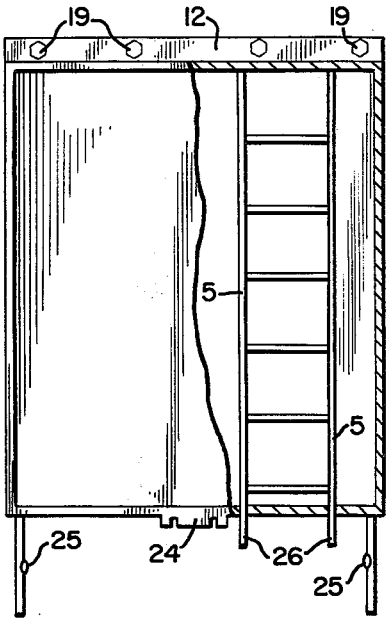

FIG. 2 shows a front view of the enclosure and the means to interlock the framework and ladder assembly to another enclosure below it. Shows a cutaway portion to view the ladder from the front. The structural joining parts are clearly shown.

Figure 3:
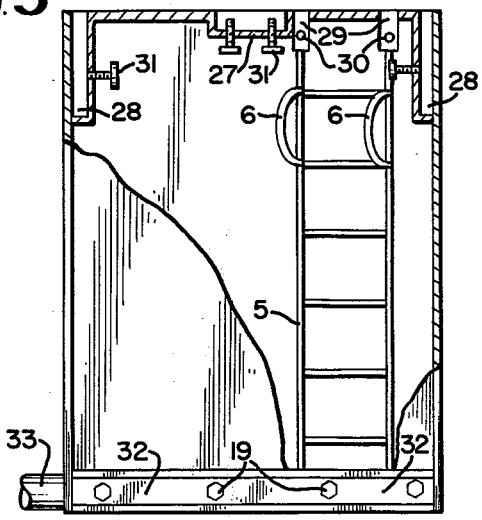

FIG. 3 shows a front cutaway view of the front of a enclosure module showing the recesses and locking means to secure the ladder and the enclosure assembly of FIG. 2. FIG. 3 also shows some of the hardware used in fastening and a different flange lock on the bottom that is finally covered by a trim piece for looks.

Figure 4:
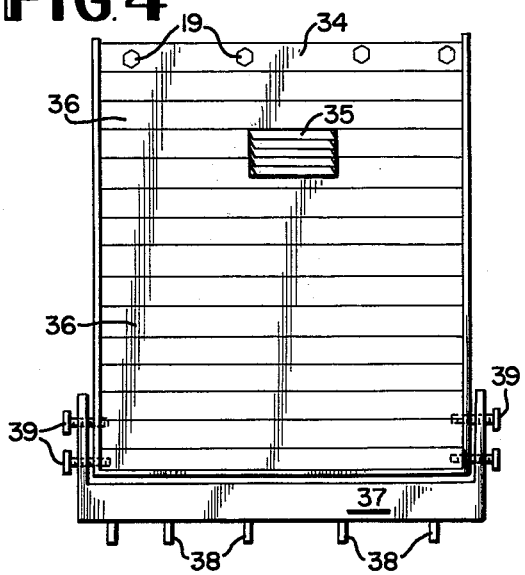

FIG. 4 shows a frontal view of the building emergency escape means having a front side ventilator and a top flange that is inserted into the bottom flange of FIG. 3 (5), which locks the front part of the modules together vertically. The locking of the inside to the wall of the building accomplishes the fastening of the enclosure safely. FIG. 4 also shows one of many ways to mount the bottom enclosure to the ground whereby FIG. 4 is provided with pre-drilled holes for bolts.

FIG. 4 A shows the locking flange anchor, footing rods and side locking bolts for the front that would also extend around the enclosure.

The operation of the embodiments in the Emergency Building Exit Means shown are as follows; FIG. 1 shows an upper level modular enclosure 1 having lifting rings 2 and a non-skid platform 3 showing a ladder cutout 4 and a vertical ladder 5 with safety holding brackets 6 and an exit door 7 in a closed position operating on hinges 8 also having a lockset and keys 9, an exhaust fan 10, a burgular alarm 11 shown battery operated and the battery 11 A. It shows a building attachment flange 12, a light and socket 13 and the inside wall views are marked 14. This is a top unit having no opening.

FIG. 1 also shows the side ventilator 15, an emergency exit light 16 and another light & socket 13 of high intensity design for use in seeing through smoke. It shows an alarm switch 17 attached to the wiring 18. Fastening bolts are shown 19 and the door 20 in open position with the inside of the building shown as 20 A.

FIG. 1 further shows a window 21 that is actually a window door combination. It is expected that an open model as shown in FIG. 3 would be desirable and economical for use on buildings without the closed in sides and can be utilized with partial sides. FIG. 3 also shows the cutout 4 in a different position, such placement is optional.

FIG. 1 further shows the front locking rods 22 and the rear locking rods 23. The device of FIG. 3-A can be useful as the bottom section of modular enclosure attachments to buildings locked into the ground and onto the building for firm support.

FIG. 2 shows a front male locking flange 24, holes for locking front rods 25 and ladder locking rods 26, part of the front is cutaway to show the position of the ladder 5.

FIG. 3 shows a recessed female rod lock 28 and a front female recessed locking flange 27 with a ladder rod locking recess 29 and ladder locking bolt holes 30 with locking bolts 31. It shows a bottom locking flange 32 with a bottom flange cover 33 which will serve as a finishing facia for decor.

FIG. 4 shows a top locking flange 34 for locking the enclosures modules together a front ventilator 35 and the front part covered 36, protected from weather.

FIG. 4 further shows a bottom attachment anchor seat 37 and footing rods 38 to secure the enclosure firmly. It shows a few of the bottom locking bolts 39, the footing rods 38 would be anchored into the ground and secured further.

The Building Emergency Exit Means shown and explained are attachable in many of the forms shown by many securing methods to the outside of all kinds of buildings providing flexibility in numbers of modules placed side by side and to any required height or width to accomodate safely any required amount of people away from hazards. The use of vertical ladder openings or offset will add to the safety factor and the use of an additional opening could easily accommodate additional passageway in the same enclosure.

Although the invention has been described in detail with respect to an exemplary embodiment thereof, it will be understood by those of ordinary skill in the art that other variations and modifications may be effected within the scope and spirit of the invention.

I claim;

1. A building emergency exit means in combination with a building structure having exit means comprising a plurality of modules in stacked relation, and connected to each other, each module comprising a bottom member and top member and having walls to form an enclosure, each module having attachment and locking means for connection to said building and to each other, opening means in said top member and bottom member matching similar openings in adjacent modules, ladder means connected between said top member and bottom member and adjacent said opening means facilitating communications between said modules, opening means in one side of said module and adjacent said exit means in said building for providing access to said modules, each module having alarm means, light means, ventilation means, and electronic communication means.

2. Apparatus as in claim 1 wherein said attachment and locking means comprises mated parts on said modules that interlock each module when placed in said stacked relation.

3. Apparatus as in claim 1 wherein said building emergency exit means includes existing windows in said building structure.

4. Apparatus as in claim 1 wherein said building emergency exit means includes existing doors in said building structure.

5. Apparatus as in claim 1 wherein said building emergency exit means has access to said module by means of doors built into said opening means in one side of said modules for exit and entry uses.

6. Apparatus as in claim 1 wherein one of said building emergency exit modular enclosures comprises an exit means attached to the outside of said enclosures for occupants to leave said enclosures.

7. Apparatus as in claim 1 wherein said ladder has standoffs keeping it away from a wall of said enclosures, said ladders having interlocking means for locking with and adjacent ladder of another module.

8. Apparatus as in claim 1 wherein the lowermost of said modules wherein stacked relation is anchored to the ground.

9. Apparatus as in claim 8 wherein one of said module has a roof section providing a weather-resistant and roof ventilation.

10. Apparatus as in claim 1 wherein said enclosure means has at least some of said top and bottom opening means in staggered relationship.

11. Apparatus as in claim 1 wherein said enclosures are provided with a prefabricated plug on top and bottom of the enclosures for connection when the units are stacked vertically so that said electronic communication, said lights, said alarm, said ventilating system will function when the units are connected to a power supply means.

* * * * *